United States Patent [19]

Hirth

[11] 4,083,600

[45] Apr. 11, 1978

[54] DENTAL CHAIR

[76] Inventor: Emil Hirth, Rosenstrasse 32, D-7502 Malsch, Germany

[21] Appl. No.: 763,507

[22] Filed: Jan. 28, 1977

[30] Foreign Application Priority Data

Jan. 29, 1976 Germany ..... 2603253
Jan. 29, 1976 Germany ..... 7602398

[51] Int. Cl.[2] ..... A47C 1/02

[52] U.S. Cl. ..... 297/316; 297/71; 297/330

[58] Field of Search ..... 297/330, 316, 319, 321, 297/85, 71

[56] References Cited

U.S. PATENT DOCUMENTS

| | | | |
|---|---|---|---|
| 3,014,757 | 12/1961 | Pilcher et al. | 297/85 |
| 3,338,632 | 8/1967 | Kleinsorge | 297/330 |
| 3,414,324 | 12/1968 | Taylor | 297/71 X |
| 3,427,072 | 2/1969 | Hale | 297/330 X |
| 3,588,170 | 6/1971 | Knabusch | 297/330 X |
| 3,804,460 | 4/1974 | Leffler | 297/71 X |
| 3,934,929 | 1/1976 | Rabinowitz | 297/319 X |

*Primary Examiner*—James T. McCall
*Attorney, Agent, or Firm*—Theodore B. Roessel; Joseph C. MacKenzie

[57] ABSTRACT

A dental chair having a backrest and a seat each of which is angularly adjustable about a common horizontal axis. A motor drives a linkage system which simultaneously angularly adjusts both backrest tilt and seat inclination to positions ranging from one in which the chair supports the patient in substantially sitting position, to one in which the patient is reclining with his head below the rest of his body. As compared to the seat, the angular motion of the backrest is relatively uniform over the range of adjustment, whereas most of the angular motion of the seat occurs during the middle 50% of the range.

8 Claims, 4 Drawing Figures

FIG. 1
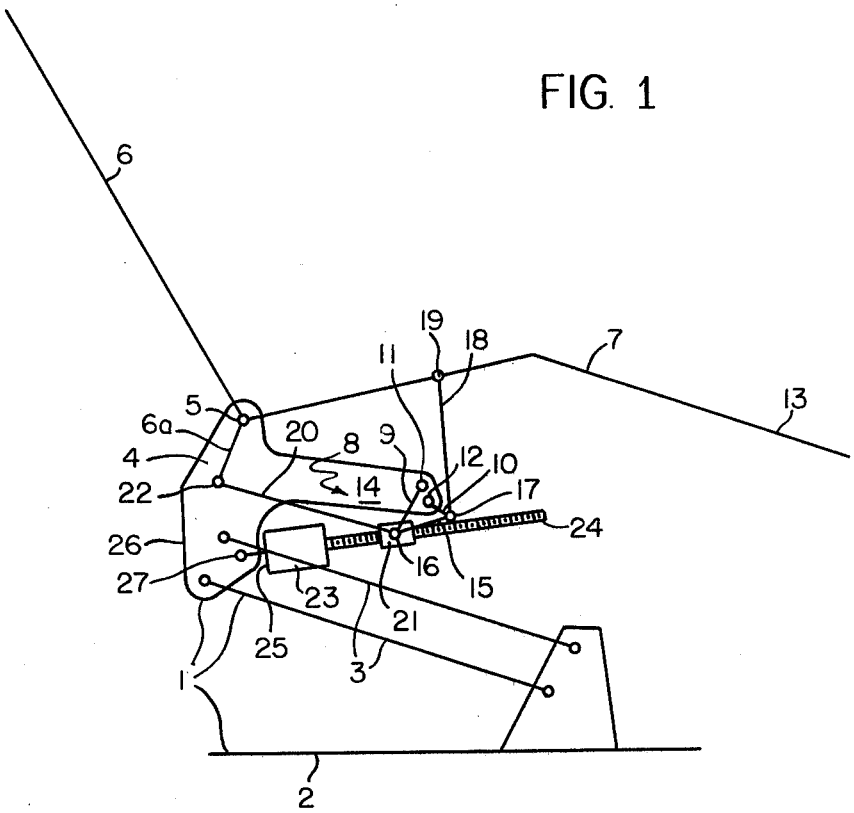
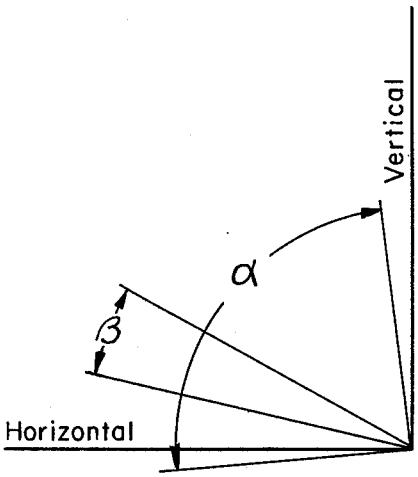
FIG. 2
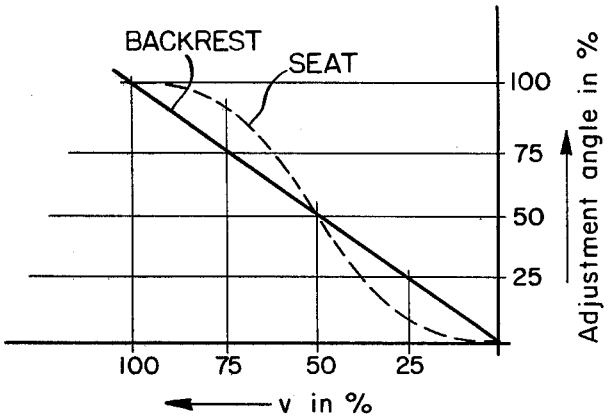
FIG. 3

DENTAL CHAIR

BACKGROUND OF THE INVENTION

The present invention relates to a dental chair comprising a lower part, and an upper part, the upper part having an inclinable seat part and a tiltable backrest, seat part and backrest being pivotally attached together, and the seat part and backrest also being connected with the lower part of the chair at a common point of support and having interdependent movements which take place by means of a common actuating member acting on seat part and backrest via a linkage system.

By means of such a dental chair the dentist should be able to bring the patient into any position appropriate for any necessary and/or desired type of treatment. By coupling together the inclining of the seat part and the tilting of the backrest, it is only necessary to control two drives, one for adjusting the backrest and the seat about a horizontal axis running through the common support and along the longitudinal axis, and one for adjusting the vertical height of the upper part with respect to the lower part.

Dental chairs of the foregoing type are already known but are so constructed that tilting the seat takes place only upon completion of the movement of the backrest and with a relatively high angular velocity. Chairs with separate drives, one for tilting the backrest and the other for tilting the seat, make a tilting possible which is more appropriate from the dentist's point of view, especially with electronic control, but such chairs are costly to construct and thus are expensive.

The drawback associated with the seat tilting at the end of the tilting movement of the backrest is that the patient may suddenly slip off the seat if the so-called "collapse" position is assumed (an extreme prone position wherein the head is lower than the heart), especially when the collapse is carried out during the treatment of the patient while in the sitting position. This means that in the case of an adjustment from the sitting position into the prone position, the angle between seat and backrest should increase only so far that the patient is relaxed, while if the adjustment is continued to the start of a collapse position the seat should not move additionally while the backrest continues to lower and thus assure the the patient remains safely on the chair. Furthermore, in many known dental chairs the seats are raised, depending on construction, by a cam or a roller, which are used by almost all chairs in the adjusting mechanism of the seat, and this can cause additional difficulty regarding the secure position of the patient, especially during the descent into the collapse position.

SUMMARY OF THE INVENTION

The present invention provides a chair wherein most of the tilting of the seat takes place during the second and third quarter of the tilting of the backrest, whereas in the sitting position of the patient (1st quarter or so of the tilting of the backrest) little tilting of the seat will take place, while in the 2nd quarter of the tilting of the backrest the main seat tilting movement begins and substantially reaches its limit in the 3rd quarter, the end of which corresponds approximately to the seat providing prone position of the patient during a treatment. The chair of the present invention also provides that, for the last quarter of the tilting movement of the backrest, corresponding to the collapse position, little tilting of the seat takes place, hence the weight of the members of the patient's body lying thereupon will not, through its kinetic energy, lead to sudden slipping of the patient from the chair when the seat is adjusted into the collapse position.

Advantages of my invention are the security and stability it gives to the patient being moved into the collapsed position. Also, the mechanism providing such security and stability is relatively simple, easy to construct, and therefore inexpensive.

BRIEF DESCRIPTION OF THE DRAWING

FIG. 1 is a side elevation view of a dental chair according to the invention, showing the linkage system and drive for adjusting backrest and seat of the chair.

FIG. 2 is a graph of the angular adjustment ranges of the backrest and seat of the chair of FIG. 1.

FIG. 3 is a graph of the angular velocities of the backrest and seat of the chair of FIG. 1.

DESCRIPTION OF THE PREFERRED EMBODIMENTS

Figure 4:
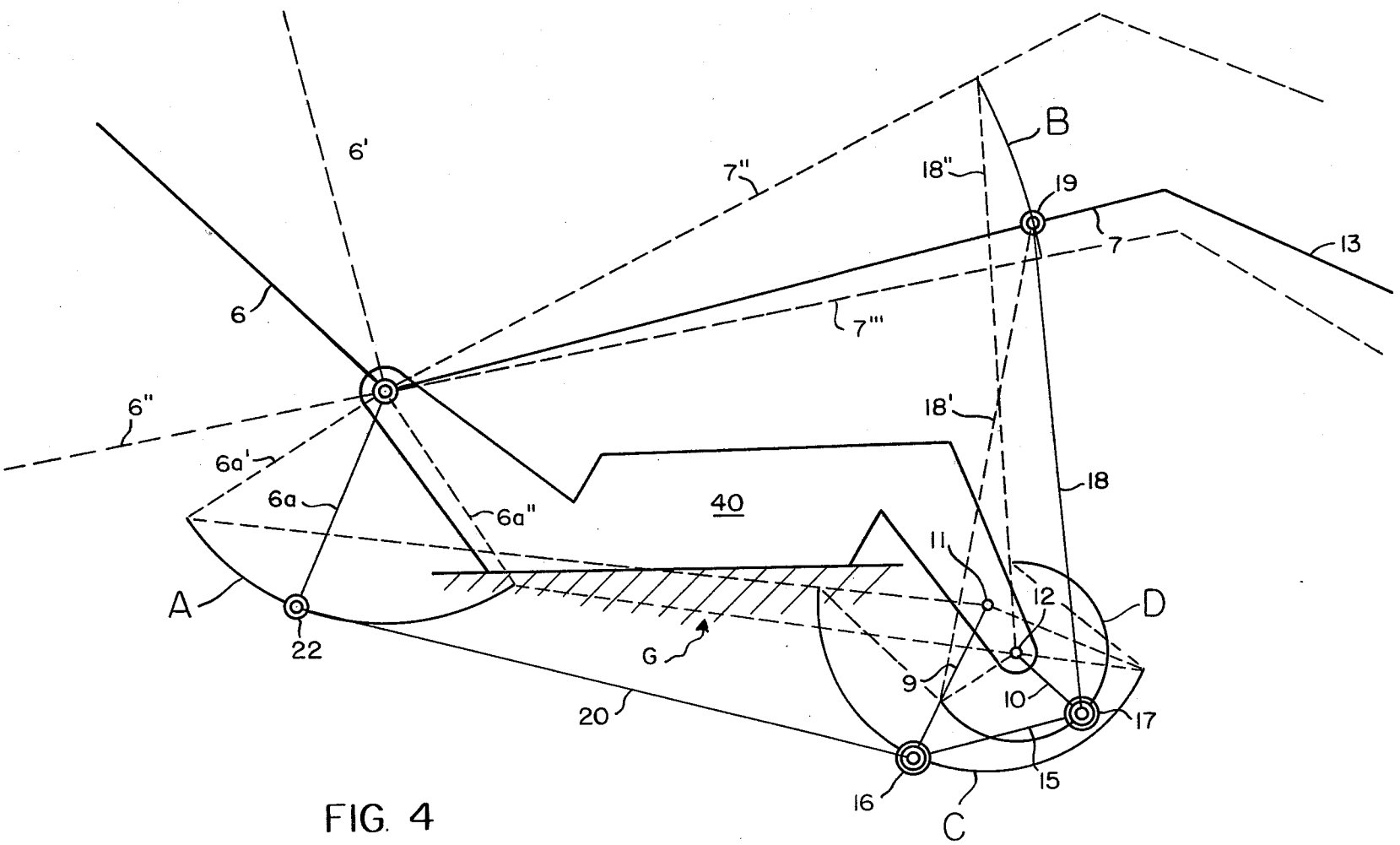
FIG. 4 is enlarged view of the linkage system of FIG. 1.

In the present invention, the linkage system for adjusting backrest and seat is so constructed and arranged that continuous tilting of the backrest from a sitting position into a prone position occurs with an almost linear angular velocity, whereas the tilting movement of the seat during the same period occurs with approximately sinusoidal angular velocity so that only during the 2nd and 3rd quarter of the tilting movement of the backrest does most of the seat tilting take place. For this purpose, a first actuating link hinged on the seat and a second actuating link hinged on the backrest, are moved by a link system which consists of two tilting links of different length, each of which is pivotally attached by one end to different spaced points of support on the lower part of the chair, and have their other ends connected to each other via a connecting link, there being pivotal connection between the shorter tilting link and the connecting link, and such pivotal connection being hinged on the actuating link which is tiltably secured on the seat. A driving member engages a pivotal connection between the longer tilting link and the connecting link. The actuating link for the backrest is pivotally connected at one end to the pivotal connection between the longer tilting link and the connecting link, and at its other end is pivotally connected with an end of the backrest extending from beyond the pivotal support of the backrest on the lower part of the chair.

The driving member for the adjustment of the seat and the backrest of the chair may be either the nut of a motor-driven threaded spindle or the piston rod of a pneumatic or hydraulic cylinder, the worm-gear spindle and motor, or the cylinder, being pivotally mounted on the lower part of the chair, with the nut or piston rod being in pivotal engagement with the pivotal connection between the longer tilting link and the connecting link.

In FIG. 1, a dental chair according to the invention has a lower part 1 including base plate 2, parallelogram arms 3 and upper part support 4. The upper part support 4 supports, transverse to the length of the chair, a horizontal shaft 5 which in turn pivotally supports backrest 6 and seat 7 in common. A linkage system 8 provides tilting links 9 and 10, which are pivoted to upper part support 4 at pivotal support points 11 and 12 in the part 14 of the upper part support 4 extending toward the foot-end 13 of the chair. The tilting link 9 is longer than the tilting link 10, and tilting links 9 and 10 are connected with each other via a connecting links 15 pivotally connected to their ends 16 and 17, which are opposite to the ends at support points 11 and 12. A actuating link 18 is pivotally connected at the connecting point of end 17, tilting link 10 and connecting link 15. At its opposite end, actuating link 18 is pivotally connected at pivotal support point 19 with the seat 7, thus providing connection between the seat and the linkage system 8, of which the tilting link 10 determines the characteristic movement of the seat.

To the pivotal connection point of end 16, tilting link 9 and connecting link 15, one end of an actuating link 20 and the driving member 21 are pivotally connected. By its other end, the actuating link 20 is pivotally connected at pivotal support point 22 with an extension **6*a* of backrest 6, which extension projects beyond the shaft 5, thus providing connection between the backrest and system 8 of which the tilting link 9 determines the characteristic movement of the backrest. As shown, actuation of linkage system 8 is by means of a threaded spindle 24, rotated by a motor 23, and by means of driving member 21 in the form of a nut driven along the spindle 24 when the motor rotates the spindle. Member 21, at least on one side, may be in the form of a bearing member having a post passing through holes in the ends of links 9, 15 and 20. Motor 23 is pivotally mounted by its one end 25 to a pivotal support point 27 on part 26 of upper part support 4** which extends towards the backrest.

The linkage system 8 in effect actually consists of two separate four-bar linkages (support 14, links 9 and 20, and extension **6*a* being one, and support 14, links 10 and 18, and seat 7 being the other) interconnected by link 15, which provides for having the driving member 21 in common to both linkages, which nevertheless creates different outputs of angular adjustment from their common drive. This is evident from FIGS. 2 and 3, wherein, in FIG. 2, the tilting angle range of the backrest is designated by $\alpha$, and the inclination angle range of the seat by $\beta$, while FIG. 3 illustrates the angular velocity of backrest and seat over the adjustment range. The graph of FIG. 3** is in terms of percent.

In FIG. 4, the motions of backrest 6 and seat 7 are shown in about the relative proportions of FIG. 1 but enlarged. As the functions of parallelogram arms 3, the distinction between upper part and lower part, and the distinction between base 2 and support, do not relate to backrest and seat adjustment, the corresponding structure has been omitted from FIG. 4. In their place, only support 40 is provided which, for present purposes, we may suppose to be fixed to mechanical ground G, notwithstanding the fact that in practice the omitted structure normally provides for such things as adjusting the vertical height of carriage 40 from the floor, and/or rotating it about a vertical axis.

We want, in essence, about 90° of angular adjustment or tilt for backrest 6, which corresponds to a sweep of pivot 22 of backrest extension **6*a* through the arc A, (i.e, 6*a* goes from 6*a*' to 6*a*''). This corresponds to a sweep of pivots 19, 16 and 17 through arcs B, C and D, respectively. If we move pivot 16 along arc C counterclockwise to the end, backrest 6 becomes substantially upright (at 6'). At the same time, pivot 19 will move with seat 7, first clockwise, to 7''' at the lower end of arc G, and then back to very nearly the position it is now shown in (which is why no separate 7' position for 7 is indicated in FIG. 4). It is evident from inspection that, starting from upright position, and going counterclockwise, (lever 18 to 18') the motion of pivot 17 has little net effect on the inclination of seat 7 until back 6 reaches the position of the solid line showing of back 6. Continuing counterclockwise, now, if pivot 17 moves up to the point where the solid line showing of link 18 intersects arc D, pivot 19 will have transversed about 85% of the arc. At this point, backrest 6** will not yet have reached the horizontal.

Further counterclockwise motion of pivot 17 along arc D, if to the upper end of the arc (link 18 to 18''), will move the backrest 16 through about seven times the angle that seat 7 goes through to reach 7'', to a point below the horizontal (at 6''). It will be noted that extension **6*a*, in the solid line position shown, is in about the middle of the second quarter of the angular range of seat back tilt, and by the time it gets just to the beginning of the fourth quarter, the net travel of the pivot 19 in the second and third quarter will have been from about the solid position shown for pivot 19 to a point about 15% from the upper end of arc B. In the fourth quarter, the seat back will tilt about 24°–25° or so, for a little more than three degrees of seat inclination. If toggle reversal of links 10 and 18 is allowed for, link 9 can go some further (to the point where it would align with link 20.) This would depress backrest 6 a few degrees beyond 6'', whereas link 18 would deflect seat 7 clockwise a little beyond 7''** which is acceptable.

Having described my invention, I claim:

1. A dental chair, comprising a lower part and an upper part, said upper part having an inclinable seat part and a tiltable backrest, said seat part and said backrest being pivotally attached together and also being pivotally connected with the lower part at a common point of support thereon and having respective independent inclining and tilting movements which take place by means of a common driving member acting on them via a linkage system, characterized in that said linkage system includes means for causing continuous tilting of the backrest, from a sitting position into a prone position, to take place with almost linear angular velocity, and in that said linkage system also includes means for inclining said seat part while said backrest is tilting, for causing such tilting to take place with approximately sinusoidal angular velocity, and for causing the main inclining movement to occur during the second and third quarters of tilting movement from sitting to prone position.

2. The dental chair of claim 1, wherein said lower part includes a base, and an upper part support vertically-adjustably supported on said base; said upper part support providing said portion to which said seat part and backrest are pivoted, and also supporting said motor means.

3. A dental chair having a lower part and an upper part, said upper part being supported on said lower part;

said upper part comprising a seat part inclinably pivoted to a portion of said lower part for adjustably inclining said seat part about a given horizontal axis;

said upper part also comprising a backrest tiltably pivoted to said portion, independently of said seat part, for adjustably tilting said backrest about said given horizontal axis;

said lower part having a motor means, said motor means having a driving member, and there being a linkage system interconnecting said driving member and said upper part;

said linkage system including first linkage means interconnecting said driving member and said backrest, and being driven by said driving member for tilting said backrest with substantially linear angular velocity through a range of chair positions for sitting to prone; and said linkage system also including second linkage means interconnecting said driving member and said seat part, and being driven by said driving member for inclining said seat part with substantially sinusoidally-varying angular velocity through said range of positions for causing the main inclining movement of said seat part to occur intermediate the sitting and prone chair positions of said range.

4. The dental chair of claim 3, wherein said lower part includes a base, and an upper part support vertically-adjustably supported on said base; said upper part support providing said portion to which said seat part and backrest are pivoted, and also supporting said motor means.

5. The dental chair of claim 3, said first linkage means including a first link pivoted at one end to said backrest and to a place thereon spaced from the place where said backrest is pivoted to said portion, a second link pivoted at one end to a first place on said lower part;

said second linkage means including a third link pivoted at one end to said seat part and to a place thereon spaced from the place where said seat part is pivoted to said portion, a fourth link pivoted at one end to said lower part at a second place thereon spaced from said first place;

a fifth link pivotally interconnecting the other end of said second link and the other end of said fourth link, said second link being longer than said fourth link;

said other end of said second link being pivotally connected to the other end of said first link, and said other end of said fourth link being pivotally connected to the other end of said third link, and there being a driving interconnection between said driving member and one of said links.

6. The dental chair of claim 5, wherein said lower part includes a base, and an upper part support vertically-adjustably supported on said base; said upper part support providing said portion to which said seat part and backrest are pivoted, and also supporting said motor means.

7. The dental chair of claim 5 wherein said driving interconnection is between said driving member and the other end of said second link.

8. The dental chair of claim 7, wherein said lower part includes a base, and an upper part support vertically-adjustably supported on said base; said upper part support providing said portion to which said seat part and backrest are pivoted, and also supporting said motor means.

* * * * *